United States Patent [19]

Tang

[11] Patent Number: 4,903,361

[45] Date of Patent: Feb. 27, 1990

[54] COMPOSITE BED COVER

[76] Inventor: Thomas L. Tang, 7 Ridge La., Lincoln, Mass. 01773

[21] Appl. No.: 285,687

[22] Filed: Dec. 16, 1988

[51] Int. Cl.[4] ..... A47G 9/00

[52] U.S. Cl. ..... 5/502; 5/500

[58] Field of Search ..... 5/502, 496, 495, 500, 5/489

[56] References Cited

U.S. PATENT DOCUMENTS

| | | | |
|---|---|---|---|
| 1,347,642 | 7/1920 | McNatt | 5/502 |
| 2,644,962 | 7/1953 | McCrory | 5/502 |
| 2,799,870 | 7/1957 | Sullivan | 5/502 |
| 3,355,748 | 12/1967 | Tuvert | 5/502 |
| 3,965,504 | 6/1976 | Ainsworth | 5/496 |
| 4,513,461 | 4/1985 | Tardivel | 5/502 |
| 4,658,454 | 4/1987 | Potter | 5/500 |

FOREIGN PATENT DOCUMENTS

| | | | |
|---|---|---|---|
| 2835646 | 3/1980 | Fed. Rep. of Germany | 5/502 |
| 500053 | 3/1954 | Italy | 5/502 |

*Primary Examiner*—Gary L. Smith
*Assistant Examiner*—F. Saether
*Attorney, Agent, or Firm*—John E. Toupal; Harold G. Jarcho

[57] ABSTRACT

A composite bed cover including a substantially rectangular bed sheet having a pair of substantially parallel sheet side edges spaced apart by a distance d and spaced apart top and bottom sheet edges joining ends of the sheet side edges and extending transversely thereto; a sheet fastener mechanism retained by the bed sheet and disposed adjacent to each of the sheet side edges; a substantially rectangular bed coverlet of substantially greater weight than the bed sheet, the coverlet having a pair of substantially parallel coverlet side edges spaced apart by a distance D at least as great as the distance d and spaced apart top and bottom coverlet edges joining ends of the coverlet side edges and extending transversely thereto; and a coverlet fastener mechanism retained by the coverlet and disposed adjacent to each of the coverlet side edges and adapted for fastenable engagement with the sheet fastener means.

7 Claims, 1 Drawing Sheet

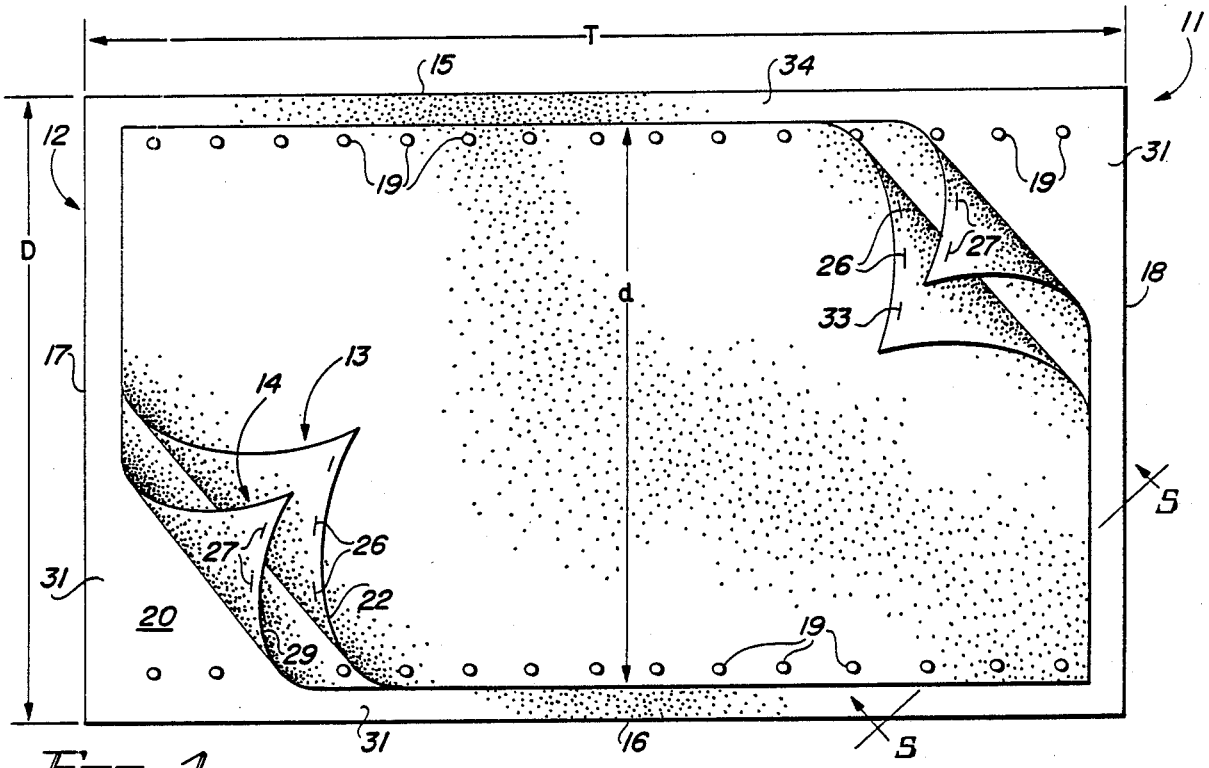
FIG. 1
FIG. 2
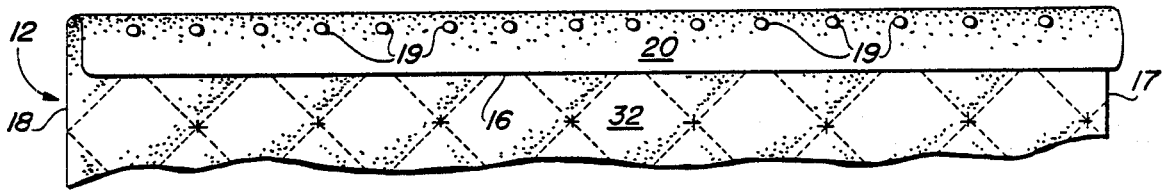
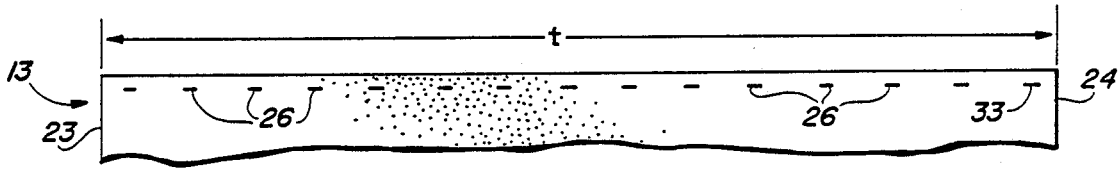
FIG. 3
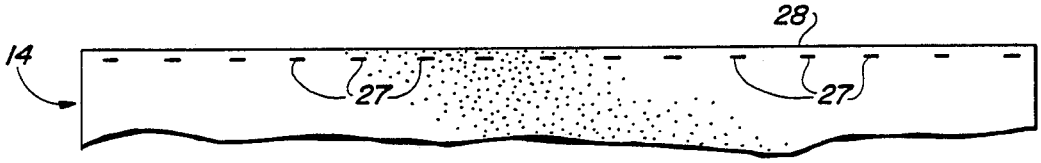
FIG. 4
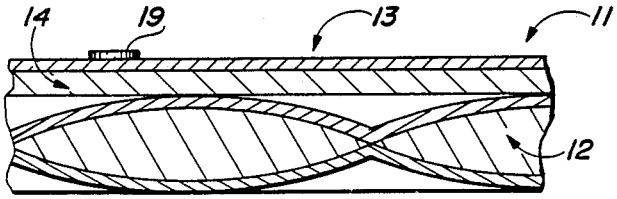
FIG. 5
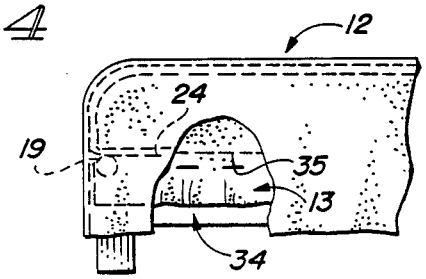
FIG. 6

COMPOSITE BED COVER

BACKGROUND OF THE INVENTION

This invention relates generally to a composite bed cover and, more particularly, to a cover that provides sleeping comfort while simplifying bed making operations.

Sheets are used extensively to both enhance sensual comfort and prevent soilage of other heavier bedding. Generally, a bottom sheet is used to cover a mattress and a top sheet is used between the bottom sheet and covering pieces such as blankets, comforters, quilts, spreads, etc. Although improving comfort and reducing laundry requirements, the use of a top sheet does introduce certain disadvantages. For example, bed making is complicated by the requirement for proper alignment between and positioning of the plural articles usually functioning as bed covers.

The object of this invention, therefore, is to provide an improved bed cover that alleviates problems associated with prior bedding combinations.

SUMMARY OF THE INVENTION

The invention is a composite bed cover including a substantially rectangular bed sheet having a pair of substantially paralell sheet side edges spaced apart by a distance d and spaced apart top and bottom sheet edges joining ends of the sheet side edges and extending transversely thereto; a sheet fastener mechanism retained by the bed sheet and disposed adjacent to each of the sheet side edges; a substantially rectangular bed coverlet of substantially greater weight than the bed sheet, the coverlet having a pair of substantially parallel coverlet side edges spaced apart by a distance D at least as great as the distance d and spaced apart top and bottom coverlet edges joining ends of the coverlet side edges and extending transversely thereto; and a coverlet fastener mechanism retained by the coverlet and disposed adjacent to each of the coverlet side edges and adapted for fastenable engagement with the sheet fastener means. This combination provides an attractive, easily made bed cover.

According to one feature of the invention, the sheet fastener mechanism comprises a plurality of individual sheet fasteners spaced apart along the sheet side edges and the coverlet fastener mechanism comprises a plurality of individual coverlet fasteners spaced apart along the coverlet side edges and each adapted for fastenable engagement with one of the sheet fasteners. The individual mating fasteners provide the desired fastening function in an efficient manner.

According to another feature of the invention, the sheet fasteners comprises openings and the coverlet fasteners comprise elements adapted to be received and retained by the openings. This arrangement facilitates the formation of a composite bed cover comprising more than two articles.

According to yet another feature of the invention, the elements are buttons and the openings are button holes. This arrangement provides desired function at low cost.

According to still another feature of the invention, the distance D is greater than said distance d. This feature insures desirable concealment of the sheet side edges.

According to a further feature of the invention, a marginal portion of the coverlet extends beyond the top, bottom and side edges of the sheet with said sheet fastener mechanism engaged with said coverlet fastener mechanism. The marginal portion insures aesthetically pleasing concealment of the entire sheet by the coverlet.

According to yet a further feature, the invention includes a substantially rectangular blanket adapted to be straddled by the sheet and the coverlet and having a plurality of fastener openings each adapted for alignment with one of the sheet openings and to receive therewith one of the coverlet elements. This combination provides the composite bed cover with more flexible utility.

DESCRIPTION OF THE DRAWINGS

These and other objects and features of the invention will become more apparent upon a perusal of the following description taken in conjunction with the accompanying drawings wherein:

FIG. 1 is a plan view of a composite bed cover according to the invention;

FIG. 2 is a plan view of a coverlet portion of the composite cover shown in FIG. 1;

FIG. 3 is a plan view of a sheet portion of the composite cover shown in FIG. 1;

FIG. 4 is a plan view of a blanket portion of the composite cover shown in FIG. 1;

FIG. 5 is a cross-sectional view taken along lines 5–5 of FIG. 1; and FIG. 6 is a partially cut-away view of a modified composite cover disposed on a bed.

DESCRIPTION OF THE PREFERRED EMBODIMENT

The composite cover 11 illustrated in FIG. 1 includes a quilt coverlet 12 (FIG. 2), a sheet 13 (FIG. 3) and a blanket 14 (FIG. 4). Defining and encompassing rectangular coverlet 12 are a pair of parallel side edges 15, 16 and top and bottom edges 17, 18, respectively, that join ends of the side edges 15, 16 and extend transversely thereto. As shown in FIG. 1, the side edges 15, 16 of the coverlet 12 are spaced apart by a distance D while the top and bottom edges 17, 18 thereof are spaced apart by a distance T. A coverlet fastener mechanism preferably comprising a plurality of button fasteners 19 are retained by the underside 20 of the coverlet 12 and extend along each of the side edges 15, 16.

Similarly encompassing the rectangular sheet 13 are a pair of parallel side edges 21, 22 and top and bottom edges 23, 24, respectively, that join ends of the side edges 21, 22 and extend transversely thereto. The sheet side edges 21 and 22 are separated by a distance d slightly less than distance D separating the side edges 15, 16 of the coverlet 12. Similarly, the top and bottom edges 23, 24 of the sheet 13 are separated by a distance t slightly less than the distance T separating the top and bottom edges 17, 18 of the coverlet 12. A fastener mechanism for the sheet 13 preferably comprises button holes 26 extending along each of the sheet side edges 21, 22 and disposed for alignment with the buttons 19 on the coverlet 12.

The blanket 14 shown in FIG. 4 also is rectangular and has a perimeter matching the perimeter of the sheet 13. A fastening mechanism for the blanket 14 preferably comprises button holes 27 extending along side edges 28 and 29 and spaced for alignment with the button holes 26 in the sheet 13 and the buttons 19 on the coverlet 12.

During use, the coverlet 12, the sheet 13 and the blanket 14 are joined to form the bed cover 11. As shown in FIG. 1, the buttons 19 adjacent each side edge 15, 16 on the underside 20 of the coverlet 12 are aligned with the button holes 26 adjacent each side edge 21, 22 of the sheet 13 and the button holes 27 adjacent each side edge 28, 29 of the blanket 14. Each of the buttons 19 then is inserted through an aligned pair of button holes 26, 27 in, respectively, the sheet 13 and the blanket 14 thereby securing the portions 12, 13 and 14 into the composite cover unit 11 with the blanket portion 14 straddled by the coverlet portion 12 and the sheet portion 13. Because of the coverlet's slightly greater dimensions D, T marginal portions 31 of the coverlet 12 extend beyond the edges of the sheet 13 and the blanket 14. The composite cover 11 then can be placed on an appropriately sized bed such that the relatively heavy coverlet 12 functions as both an insulative cover and a bedspread, while the substantially lighter sheet 13 functions as a top sheet. Obviously, the blanket 14 can be eliminated from the composite cover 11 in those instances when sufficient warmth is provided by the coverlet 12.

Because of the composite nature of the cover 11, bed making operations are significantly simplified. As the coverlet 12 is disposed in proper position on a bed, the retained sheet and blanket 14 are simultaneously moved into proper intermediate positions. Furthermore, the sheet and blanket portions 13, 14 are concealed by the attractive upper surface 32 of the coverlet 12.

An important advantage of the composite cover 11 is provided by a specific fastener button hole closely adjacent to each end of the bottom edge 24 of the sheet 13. With a composite cover 11 comprising a coverlet 12 and a sheet 13 positioned on an appropriately sized bed 34, the quilt portion 12 will overly and conceal a mattress 35 as shown in FIG. 6. In addition, the bottom edge 24 of the sheet 13 can be pulled under the bottom end of the mattress 35 and aligned buttons 19 on the coverlet 12 inserted through the bottom button holes 33 of the sheet 13. With the bottom holes 33 of the sheet 13 thus retained by the buttons 19 on the coverlet 12, a secure pocket is provided at the bottom portion of the sheet 13 and inadvertent displacement of the cover 11 is retarded.

Obviously, many modifications and variations of the present invention are possible in light of the above teachings. It is to be understood, therefore, that the invention can be practiced otherwise than as specifically described.

What is claimed:

1. A composite bed cover comprising:

a substantially rectangular bed sheet having a pair of substantially parallel sheet side edges and spaced apart top and bottom sheet edges each joining different ends of said sheet side edges and extending transversely thereto;

sheet fastener means comprising openings in said bed sheet and disposed adjacent to each of said sheet side edges;

a substantially rectangular bed coverlet positioned above said bed sheet substantially greater weight than said bed sheet, said coverlet having a pair of substantially parallel coverlet side edges and spaced apart top and bottom coverlet edges each joining different ends of said coverlet side edges and extending transversely thereto; and coverlet fastener means retained by said coverlet and disposed adjacent to each of said coverlet side edges and adapted for fastenable engagement with said sheet fastener means, said coverlet fastener means comprising elements spaced apart along said coverlet side edges and adapted to be received and retained by said openings in said bed sheet, and wherein a marginal portion of said coverlet extends beyond said top, bottom and side edges of said sheet with said sheet fastener means engaged with said coverlet fastener means.

2. A composite bed cover according to claim 1 wheein said elements are bottons and said openings are button holes.

3. A composite bed cover according to claim 1 wherein one of said sheet fasteners is disposed closely adjacent to each end of said sheet bottom edge.

4. A composite bed cover according to claim 3 wherein said elements are buttons and said openings are button holes.

5. A composite bed cover according to claim 1 including a substantially rectangular blanket adapted to be straddled by said sheet and said coverlet, and having a plurality of blanket fastener openings each adapted for alignment with one of said sheet fastener openings and to receive therewith one of said elements 6. A composite bed cover according to claim 5 wherein said elements are buttons and said openings are button holes.

7. A composite bed cover according to claim 5 wherein one of said first fasteners is disposed closely adjacent to each end of said sheet bottom edge.

* * * * *